US012800253B2

(12) United States Patent
Moore

(10) Patent No.: US 12,800,253 B2
(45) **Date of Patent: *Nov. 17, 2026**

(54) DIRECT FIRE WEAPON SYSTEM TRAINING AND FIRING AID

(71) Applicant: Dennis Joseph Moore, Mesa, AZ (US)

(72) Inventor: Dennis Joseph Moore, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/177,921

(22) Filed: Apr. 14, 2025

(65) Prior Publication Data

US 2025/0257970 A1 Aug. 14, 2025

Related U.S. Application Data

(63) Continuation of application No. 18/050,594, filed on Oct. 28, 2022, now Pat. No. 12,276,471, which is a continuation-in-part of application No. 17/153,598, filed on Jan. 20, 2021, now Pat. No. 11,486,678, which is a continuation-in-part of application No. 17/060,033, filed on Sep. 30, 2020, now Pat. No. 11,486,673.

(60) Provisional application No. 62/963,864, filed on Jan. 21, 2020, provisional application No. 62/916,043, filed on Oct. 16, 2019.

(51) Int. Cl.
*F41A 27/30* (2006.01)
*F41A 33/00* (2006.01)

(52) U.S. Cl.
CPC ..... *F41A 27/30* (2013.01); *F41A 33/00* (2013.01)

(58) Field of Classification Search
CPC ..... F41C 23/04; F41C 23/10; F41C 23/12; F41C 23/14; F41C 23/16
See application file for complete search history.

(56) References Cited

U.S. PATENT DOCUMENTS

| | | | | |
|---|---|---|---|---|
| 628,840 | A | 7/1899 | Normand et al. | |
| 1,436,536 | A | 11/1922 | Russell et al. | |
| 1,651,299 | A | 11/1927 | Stansel | |
| 2,388,489 | A | 11/1945 | Markey | |
| 3,162,966 | A | 12/1964 | Coss | |
| 3,648,396 | A | 3/1972 | Smith | |
| 3,798,818 | A | 3/1974 | Casull | |
| 4,296,566 | A | 10/1981 | Campos | |
| 7,065,914 | B1 | 6/2006 | Wagner | |
| 8,448,561 | B2 | 5/2013 | Carroll et al. | |
| 11,486,678 | B2 | 11/2022 | Moore | |
| 12,276,471 | B2 * | 4/2025 | Moore | F41A 33/00 |
| 2012/0159831 | A1 | 6/2012 | La France et al. | |

(Continued)

FOREIGN PATENT DOCUMENTS

WO 2017188904 2/2017

*Primary Examiner* — Bret Hayes
(74) *Attorney, Agent, or Firm* — Schmeiser Olsen

(57) ABSTRACT

A weapon system training and firing aid comprising a shoulder bar attachment for elevating and/or traversing a weapon system is disclosed. It may have an elongate arm for attachment to the weapon system and extending in a generally rearward direction from the weapon system. Once coupled to a weapon system, it gives a user a stable method of supporting and moving the weapon system, allowing the user to quickly elevate and traverse the weapon system by giving the user an additional point of contact, for example at the shoulder or under the arm, to support and stabilize the weapon system.

18 Claims, 18 Drawing Sheets

(56) References Cited

U.S. PATENT DOCUMENTS

| | | | | |
|---|---|---|---|---|
| 2014/0053447 | A1* | 2/2014 | Singh | F41C 23/06<br>42/71.02 |
| 2016/0025441 | A1 | 1/2016 | Lung et al. | |
| 2016/0282084 | A1* | 9/2016 | Hollis | F41C 33/001 |
| 2020/0263945 | A1 | 8/2020 | Todd et al. | |

* cited by examiner

DIRECT FIRE WEAPON SYSTEM TRAINING AND FIRING AID

CROSS REFERENCE TO RELATED APPLICATION

This application is a continuation of U.S. patent application Ser. No. 18/050,594, filed Oct. 28, 2022, which is a continuation-in-part of U.S. patent application Ser. No. 17/153,598, filed Jan. 20, 2021, now U.S. Pat. No. 11,486,678, issued on Nov. 1, 2022, which is a continuation-in-part of U.S. patent application Ser. No. 17/060,033, filed Sep. 30, 2020, now U.S. Pat. No. 11,486,673, issued on Nov. 1, 2022, which claims priority to U.S. Provisional Patent Application Ser. No. 62/916,043, filed Oct. 16, 2019, the disclosures of which are hereby incorporated entirely herein by reference. U.S. patent application Ser. No. 17/153,598 also claims priority to U.S. Provisional Patent Application Ser. No. 62/963,864, filed Jan. 21, 2020, the disclosures of which are hereby incorporated entirely herein by reference.

BACKGROUND OF THE INVENTION

Technical Field

This invention relates generally to armaments, and particularly to a weapon training and firing aid comprising a shoulder bar attachment for elevating and/or traversing a weapon system.

State of the Art

Conventional direct fire, externally-powered weapon systems, such as the M134 family of weapon systems, for example, and other U.S. and International weapon systems, rely on powered or mechanical devices to traverse and elevate the weapon. Such devices are generally integral to the weapon mount to which the weapon is mounted. When faced with multiple targets in various directions and/or at different ranges, the mechanical movement is typically very slow. If a user chooses to bypass these mechanical traversing and elevation devices, the systems, then described as "free", become heavy, unstable, and/or inaccurate. Other conventional weapon systems are internally powered that are also generally coupled to a mount in a preferred configuration for operation. These systems suffer from similar issues as to externally powered weapon systems. Accordingly, there is a need for a means of stabilizing and improving the accuracy of a weapon, mounted to a weapon mount, while free of a mechanical traversing and/or elevating device.

SUMMARY OF THE INVENTION

The present invention relates to armaments, and particularly to a weapon system training and firing aid comprising a shoulder bar attachment for elevating and/or traversing a weapon system.

An embodiment may include a direct fire weapon system training and firing aid, comprising: an elongate arm, wherein the arm comprises a first end configured to be coupled to a direct fire weapon system for accommodating coupling thereto, and an opposed distal end configured to extend in a rearward direction from the weapon system; a receiver extending perpendicularly from the first end, the receiver comprising: an upper surface configured to engage a lower surface of a cross member of a spade grips device of the weapon system, the lower surface having at least two apertures extending therethrough; and at least two mounting apertures extending through the receiver and corresponding to at least two apertures in the cross member; and threaded couplers inserted through the at least two mounting apertures in the receiver, the at least two apertures in the cross member and threaded into corresponding threaded recesses in a grip of the spade grips device.

Another embodiment includes a direct fire weapon system training and firing aid, comprising: an elongate arm, wherein the arm comprises a first end configured to be coupled to a direct fire weapon system without modification of the weapon system for accommodating coupling thereto, and an opposed distal end configured to extend in a rearward direction from the weapon system; a receiver extending perpendicularly from the first end, the receiver comprising: an upper surface configured to engage a lower surface of a cross member of a spade grips device of the weapon system; a threaded aperture on the upper surface of the receiver, wherein a bolt extending through and holding a grip of the spade grips in place engages the threaded aperture to couple the receiver to the cross member of the spade grips, and at least one threaded recess on each of two opposed sides thereof; and a C-shaped clamp, comprising: a channel therethrough for receiving the cross member and the receiver therethrough to keep the receiver from rotating when coupled to the spade grips; and at least one mounting bolt aperture through each of a pair of opposed parallel legs thereof corresponding to the at least one threaded recess for receiving a mounting bolt therethrough, wherein the receiver is configured to be further coupled to the cross member by at least one mounting bolt inserted through each of the at least one mounting bolt aperture and threaded into the corresponding at least one threaded recess.

Another embodiment may include a direct fire weapon system training and firing aid, comprising: a replacement grip for a spade grips device of a direct fire weapon system; and an elongate arm, wherein the arm comprises a first end rotatably coupled to the replacement grip; wherein the replacement grip is coupled between an upper cross member and a lower cross member of the spade grips device in a location to replace an original grip of the spade grips device, wherein an opposed distal end of the elongate are extends in a rearward direction from the weapon system when the replacement is coupled to the spade grips device.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in conjunction with the Figures, wherein like reference numbers refer to similar items throughout the Figures, and:

DETAILED DESCRIPTION OF EMBODIMENTS OF THE INVENTION

As discussed above, embodiments of the present invention relate to armaments, and particularly to a weapon system training (aiming) and firing aid comprising a shoulder bar attachment, giving leverage to a user for manual and rapid training of a weapon system mounted to a weapon mount, by quickly and accurately elevating and/or traversing the weapon system.

Figure 1:
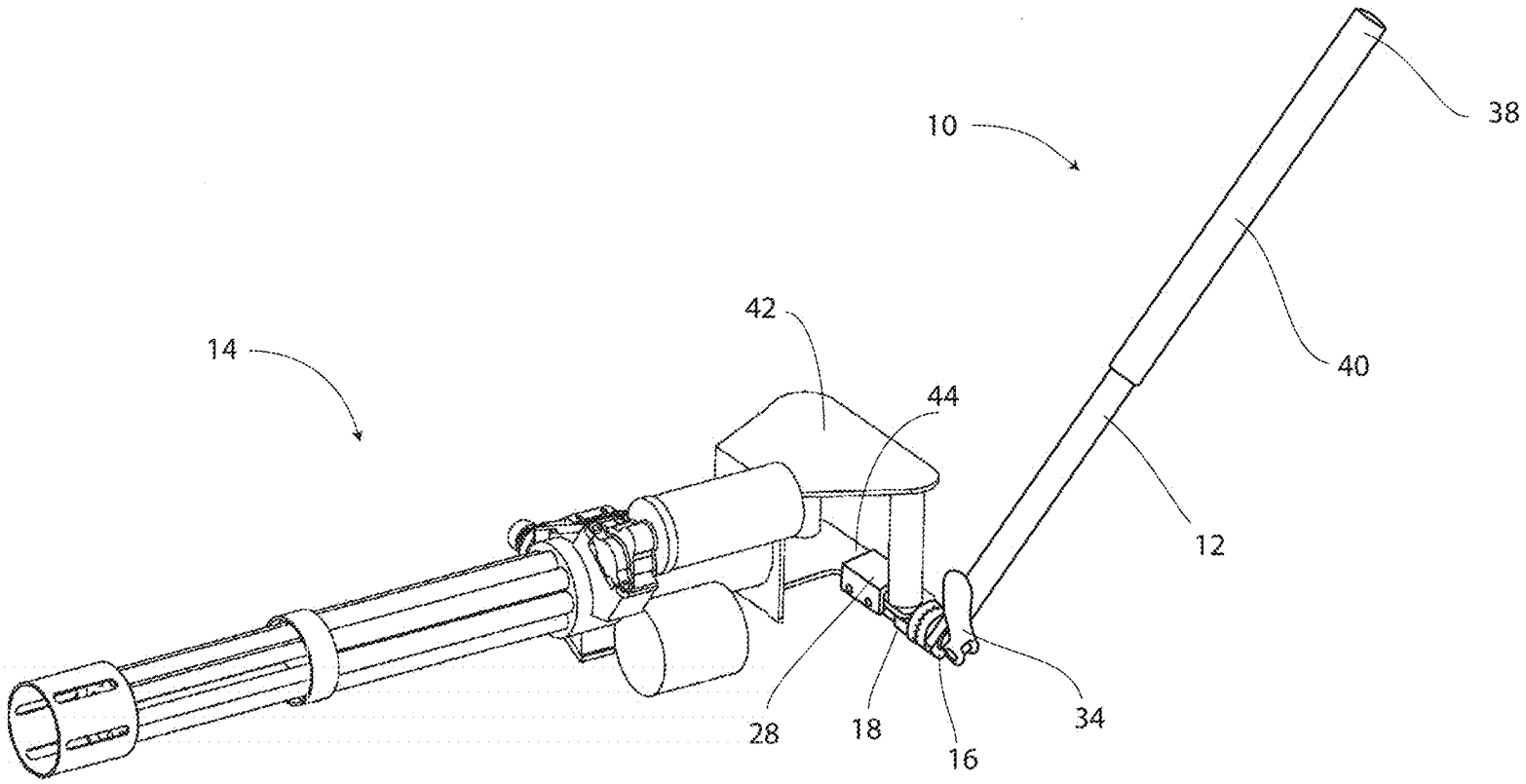
FIG. 1 is a perspective view of an embodiment of a weapon system training and firing aid coupled to a conventional M134D weapon system.
Figure 2:
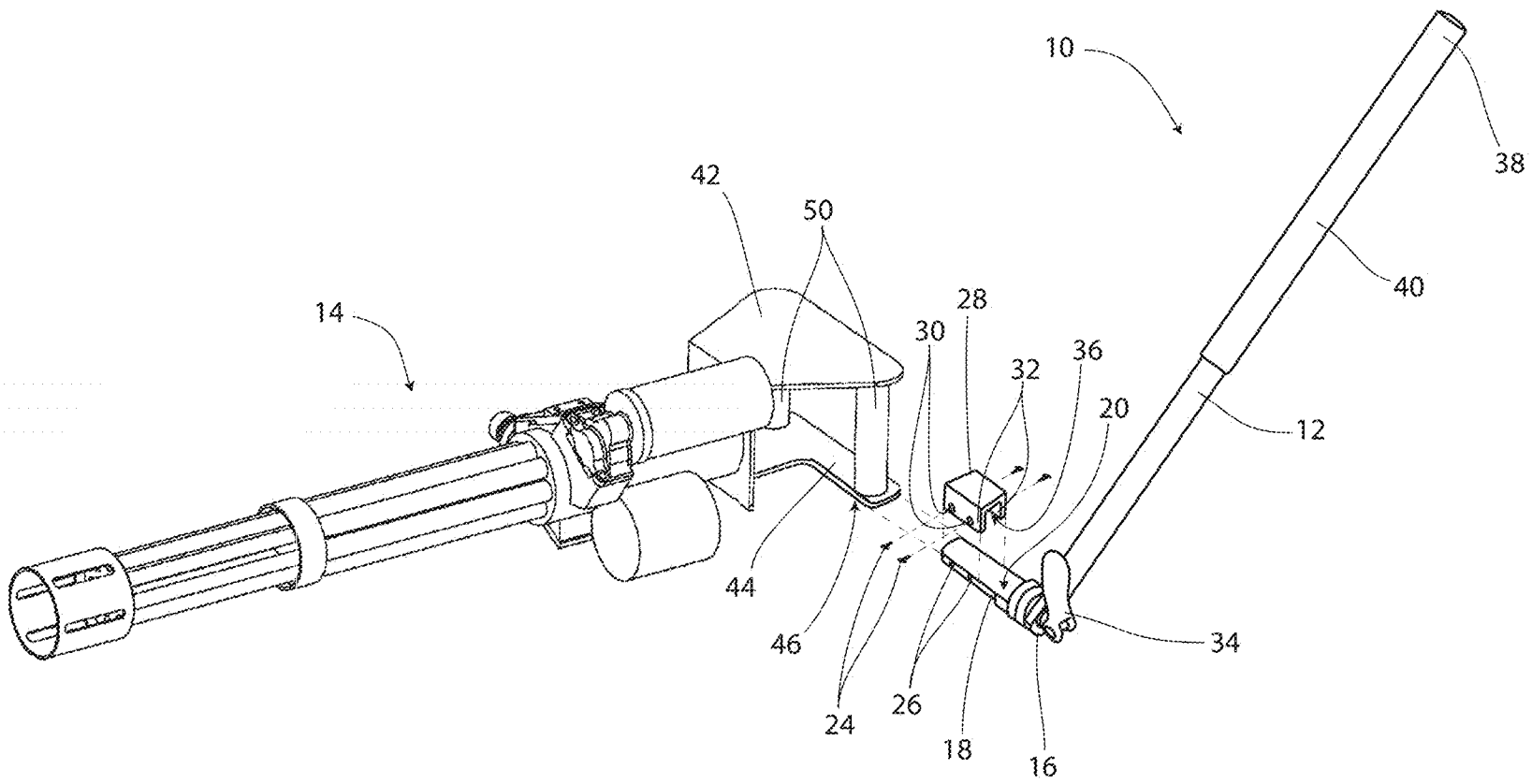
FIG. 2 is a partially-exploded perspective view of a weapon system training and firing aid with a conventional M134D weapon system, according to an embodiment.
Figure 3:
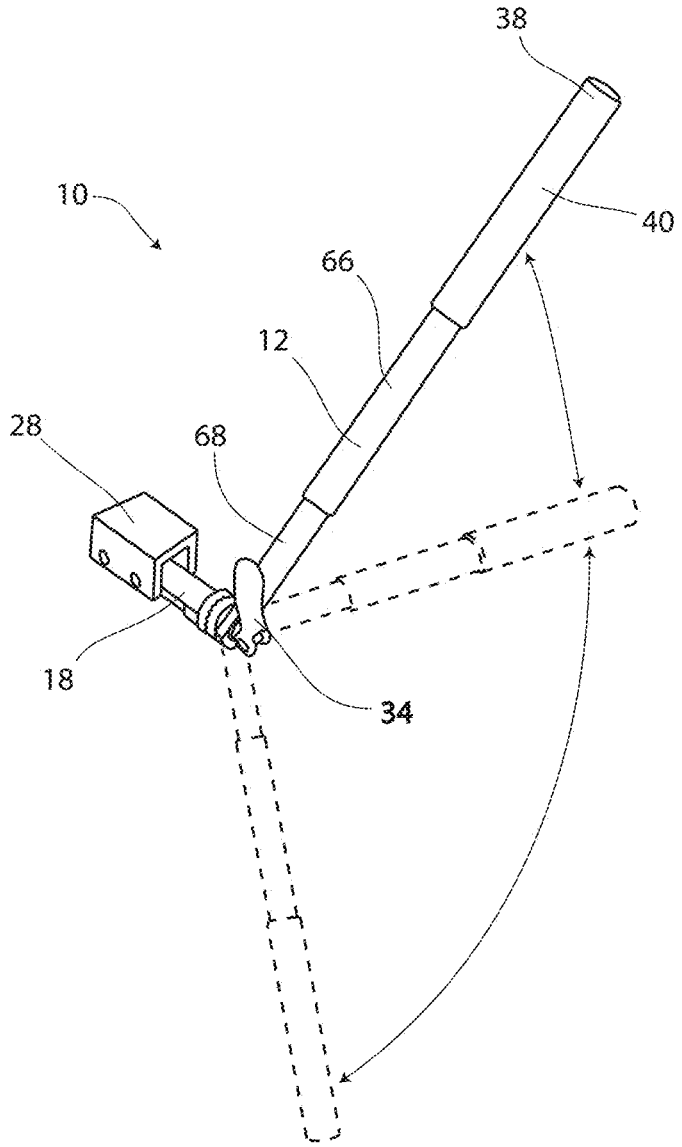
FIG. 3 is a perspective view of a weapon system training and firing aid, according to an embodiment.

Referring to the drawings, FIGS. 1-3 illustrate a weapon system training and firing aid 10, according to an embodiment. A weapon system training and firing aid 10 (hereinafter "Aid") may comprise an elongate arm 12 configured to be coupled to a weapon system 14, such as an M134D direct fire weapon system, for example, without modification of the weapon system 14, wherein a first end 16 of the Aid 10 is coupled to the weapon system 14 and the arm 12 extends in a generally rearward direction from the weapon system 14, as shown in FIG. 1.

An Aid 10, of the present invention may comprise a receiver 18, extending perpendicularly from the first end 16, for coupling the arm 12 to a weapon system 14. For example, the M134D direct fire weapon system 14, shown in FIG. 2, comprises spade grip device 42, having a lower cross member 44 coupled between two grips 50. Receiver 18 may be configured to be coupled to spade grip device 42, wherein an upper surface 20 of receiver 18 engages a lower surface 46 of cross member 44 and is secured thereto by C-shaped clamp 28, and wherein the lower cross member 44 and receiver 18 extend through a channel 36 of C-shaped clamp 28, and opposed legs 32 of C-shaped clamp 28 are secured to receiver 18 by mounting bolts or screws 24. Channel 36 may be sized appropriately to accommodate lower cross member 44 and receiver 18 with minimal clearance in order to minimize relative motion between lower cross member 44 and receiver 18 when coupled together. As shown in FIG. 2, mounting bolts 24 may extend through mounting bolt apertures 30 in legs 32 of C-shaped clamp 28 and into threaded recesses 26 of receiver 18.

Figure 7A:
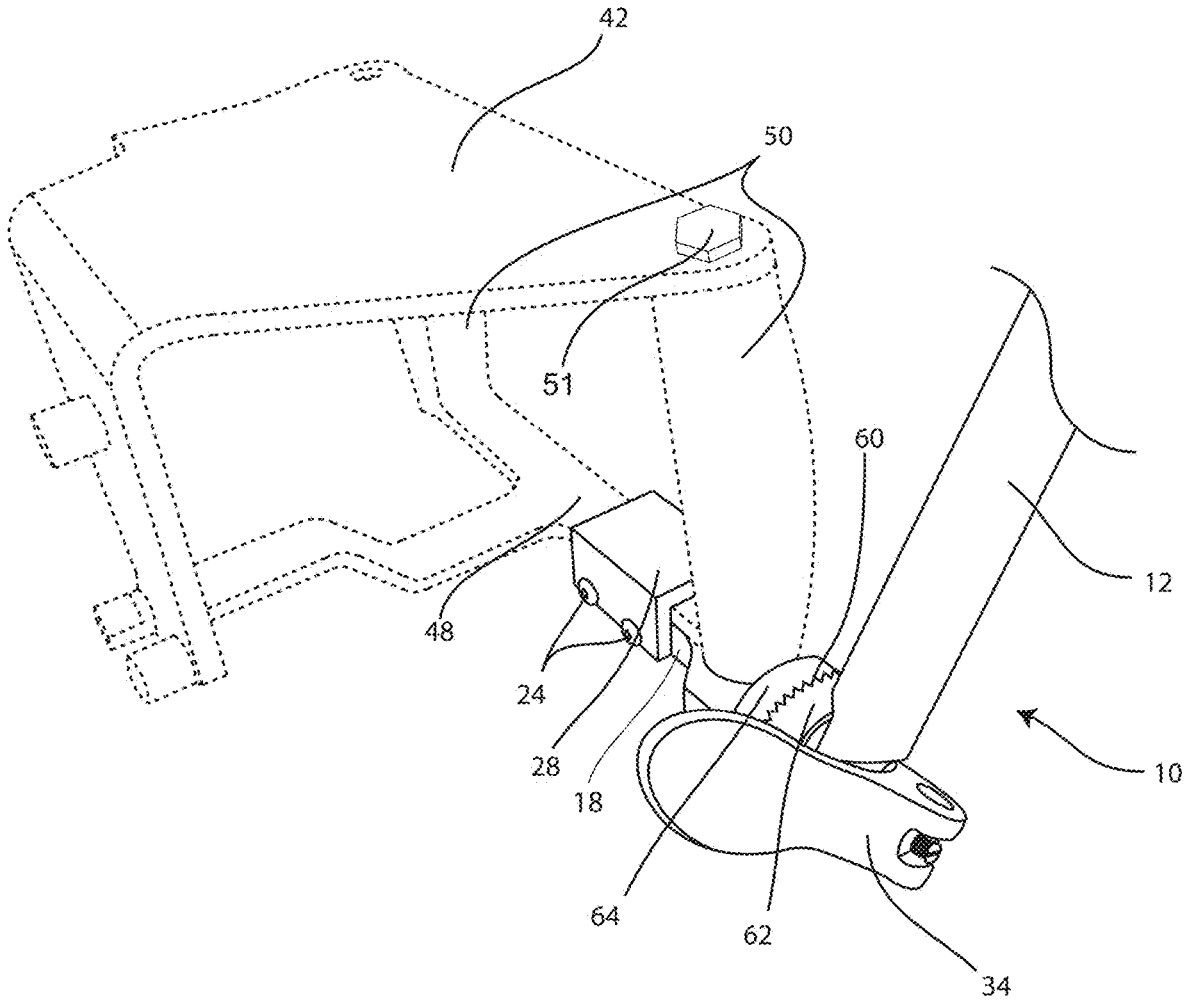
FIG. 7A is a perspective view of a weapon system training and firing aid coupled to the spade grips of a conventional direct fire weapon system, according to an embodiment.
Figure 7B:
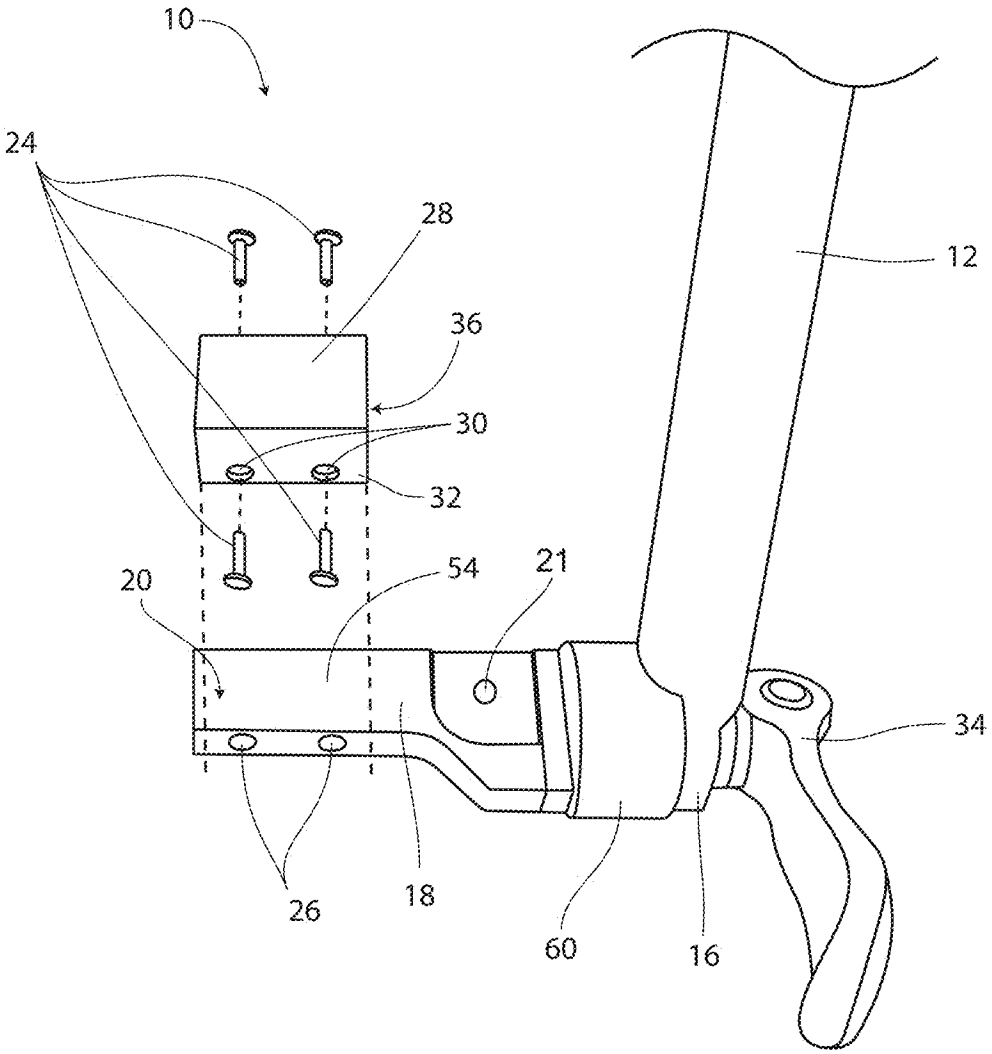
FIG. 7B is a partially-exploded perspective view of a weapon system training and firing aid, according to an embodiment.

In some embodiments, as shown in FIGS. 7A and 7B, the receiver 18 may further include an aperture 21 through the upper surface 20 of the receiver 18. The aperture 21 may be a threaded aperture 21. The aperture 21 operates to receive a bolt 51 that coupled the grip 50 to the spade grip device 42, wherein the bolt 51 extend through the grip 50 and couples to the aperture 21 of the receiver 18. In this embodiment, C-shaped clamp 28 operates to further couple the receiver 18 to the spade grip, but further, the C-shaped clamp 28 operates to prevent the receiver 18 from rotating. In another embodiment, aperture 21 is a nonthreaded hole. In this embodiment, the bolt 51 may include a nut, such as a nylock nut on the opposite side of surface 20 that bolt 51 engages to retain receiver 18.

Figure 4:
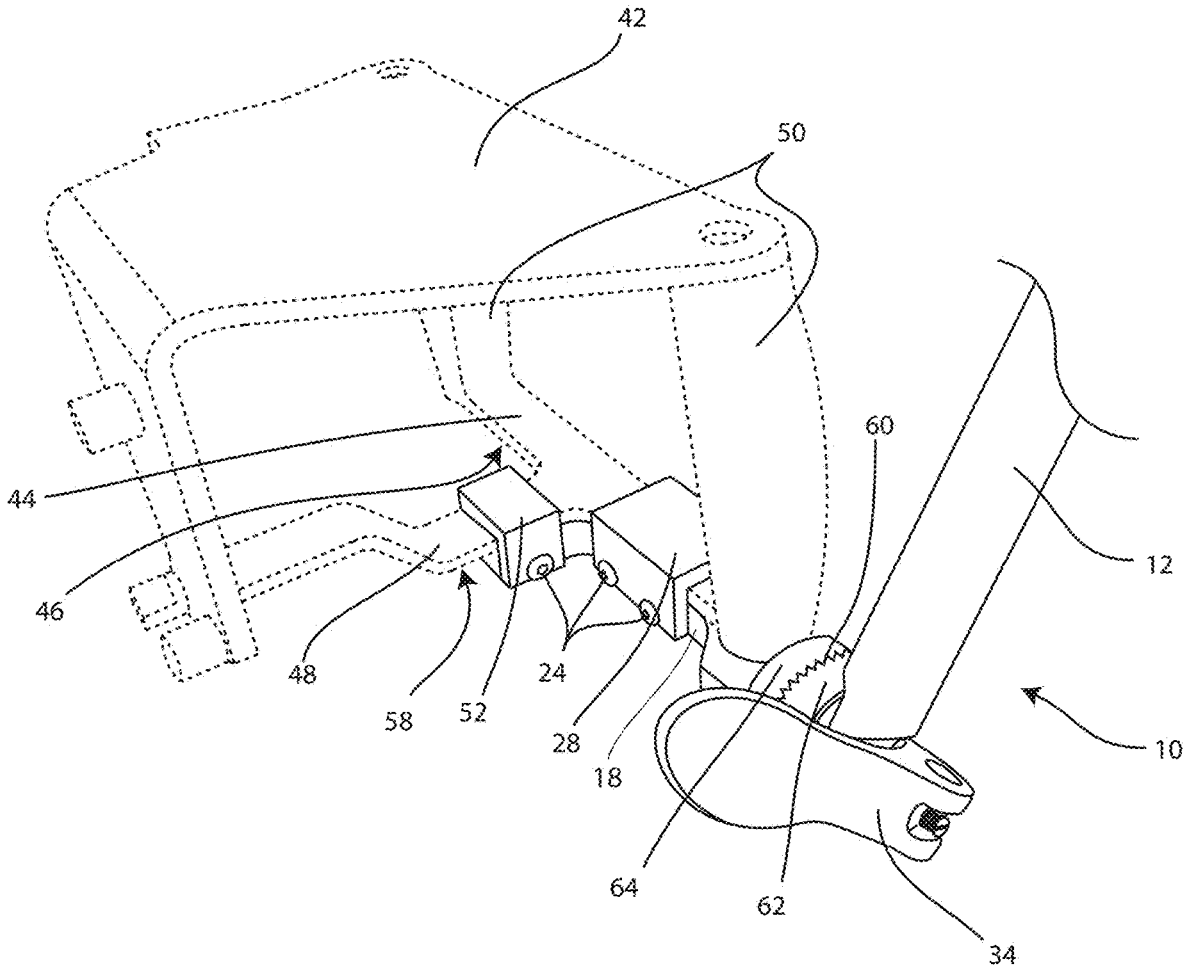
FIG. 4 is a perspective view of a weapon system training and firing aid coupled to the spade grips of a conventional direct fire weapon system, according to an embodiment.
Figure 5:
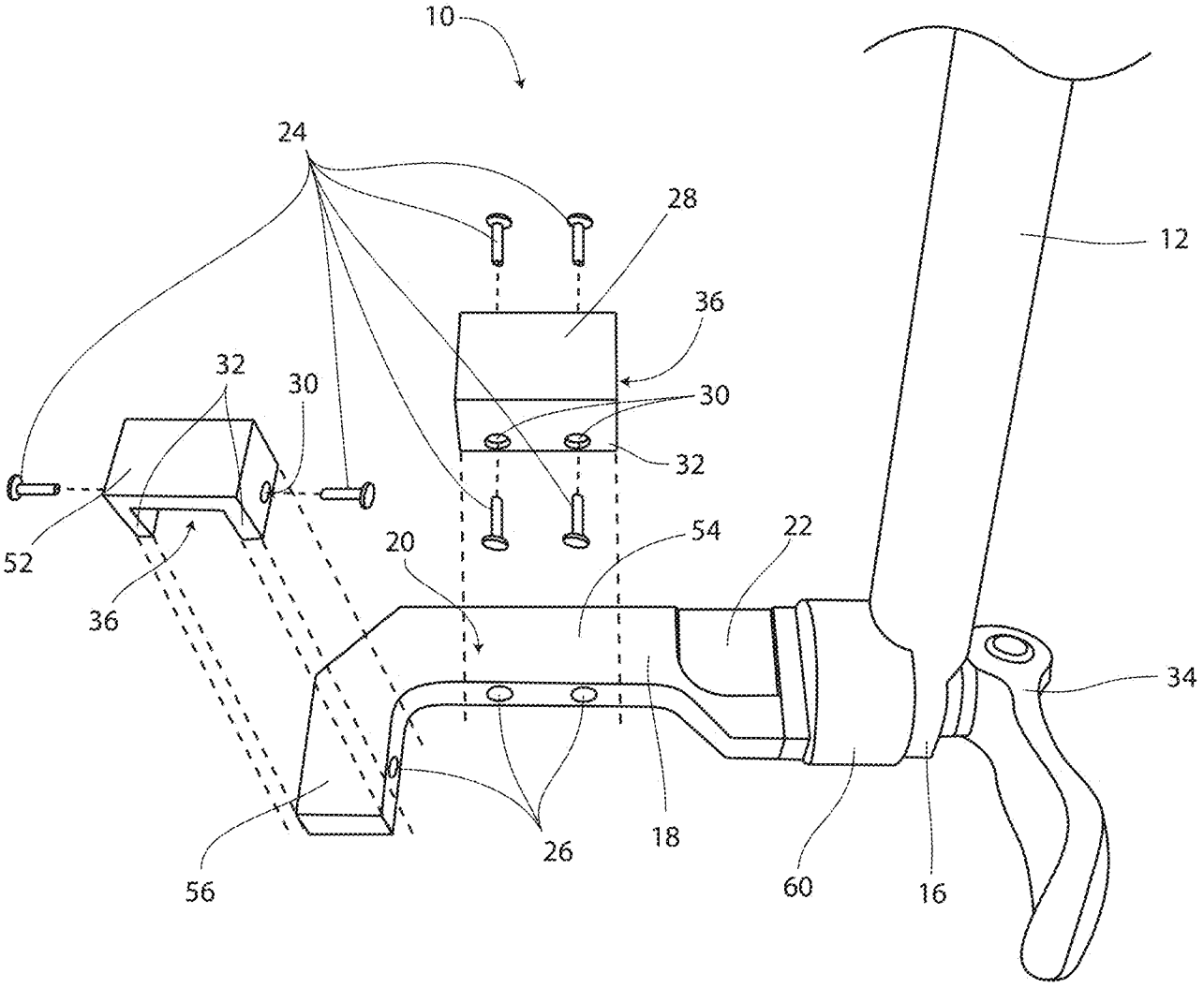
FIG. 5 is a partially-exploded perspective view of a weapon system training and firing aid, according to an embodiment.

In some embodiments, as shown in FIGS. 4 and 5, receiver 18 may be L-shaped, having first leg 54 and second leg 56 extending perpendicularly therefrom, wherein FIG. 4 shows a conventional spade grips device 42 in dashed lines and an Aid 10, of the present invention, in solid lines. In such embodiments, second leg 56 may be configured to engage a lower surface 58 of cross member brace 48 of a spade grip device 42. A second C-shaped clamp 52 may be configured to secure the second leg 56 to cross member brace 48 in a similar manner as how the first leg 54 of receiver 18 is secured to cross lower cross member 44, as described above. Securing a second leg 56 to cross member brace 48, in this manner, provides additional stability and restriction of motion between spade grip device 42 and receiver 18. In some embodiments, as shown in FIG. 5, receiver 18 may comprise a recess 22 in the upper surface 20 for accommodating grip-mounting hardware (not shown) or other profile features of the lower surface 46 of cross member 44.

Referring to FIG. 3, some embodiments of Aid 10 may comprise a quick-release mechanism 34 coupled between arm 12 and receiver 18. The quick-release mechanism 34 provides a means of adjusting the angle of arm 12 with respect to the direction of fire of weapon system 14, when coupled thereto. In operation of the embodiment shown in FIG. 3, the angle of arm 12 with respect to the direction of fire of weapon system 14 may be adjusted by first releasing quick-release mechanism 34, adjusting the angle of arm 12, and the securing quick-release mechanism 34 again. For example, in some cases, a user may wish to extend distal end 38 of arm 12 over the user's shoulder, in which case arm 12 may be adjusted to extend upward over the user's shoulder. In other cases, a user may wish to extend distal end 38 of arm 12 under the user's arm and to the user's side, in which case arm 12 may be adjusted to extend in a lower direction under the user's arm and to the user's side. The direction of rotation of arm 12, about the quick-release mechanism 34, is indicated in FIG. 3 by the arrows, and alternative exemplary non-limiting relative positions of arm 12 are shown in dashed lines. Such angle adjustments may accommodate users of different sizes and heights, and having different angle preferences, for example. In some embodiments, quick-release mechanism 34 may be configured to secure and release a splined coupler 60, wherein a first portion 62 of splined coupler 60 is coupled to first end 16 of arm 12 and a second portion 64 of splined coupler 60 is coupled to receiver 18. When quick-release mechanism 34 is secured, splines of the first portion 62 engage corresponding splines of the second portion 64 to prevent rotation of the first portion 62 with respect to the second portion 64. When quick-release mechanism 34 is disengaged, first portion 62 is free to rotate with respect to second portion 64. In some embodiments, the quick-release mechanism 34 may be spring-loaded or the splined coupler 60 may be spring loaded, such as a spring between the first portion 62 and the second portion 64 to bias them apart, wherein the quick release mechanism operates to move the first portion 62 and the second portion 64 between an engaged position and a disengaged position by applying force or releasing force. Quick-release mechanism 34 may be large enough to be quickly and easily manipulated by a user wearing gloves.

Figure 6:
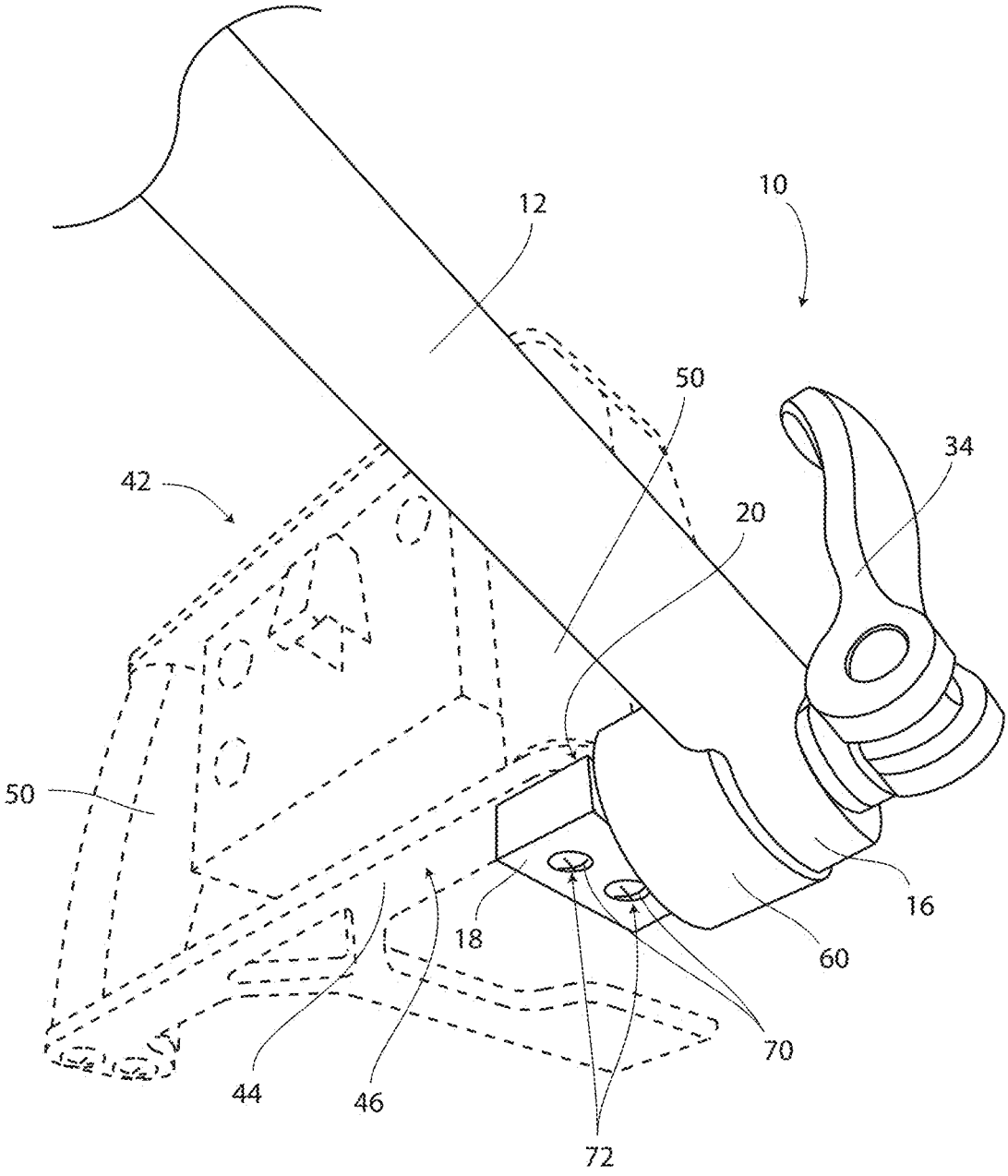
FIG. 6 is a perspective view of a weapon system training and firing aid, according to an embodiment.

Although Aid 10, as shown in the drawings, and described above, is configured to be coupled to a conventional M134D direct fire weapon system in the manner shown in the drawings and described above, this is not intended to be limiting. For example, Aid 10 may be configured to be coupled to either the right or left side of a direct fire weapon system 14. In addition, Aid 10 may be configured to be coupled directly to the receiver or other suitable location on a direct fire weapon system 14, without modification of the direct fire weapon system 14. Furthermore, Aid 10 may be configured to be coupled to any of a variety of other direct fire weapon systems known now or in the future, and by any of a variety of coupling means, known now or in the future. Such a weapon system 14 may be externally-powered, whether the external power is provided manually, mechanically, electrically, pneumatically, hydraulically, or any combination thereof. For example, embodiments of an Aid 10 may be coupled to a direct fire weapon system 14 by one or more screws, clips, pins, quick-release pins, clamping devices, and the like, with or without a C-shaped clamp 28, wherein the Aid 10 is configured to be coupled to the weapon system 14 without modification of the weapon system 14. As an illustrative example, FIG. 6 illustrates an alternative embodiment of Aid 10, coupled to a conventional spade grip device 42 (shown in dashed lines), wherein the receiver 18 comprises a pair of mounting apertures 72 therethrough corresponding to through holes in the lower cross member 44 through which mounting threaded couplers 70 inserted and threaded into corresponding threaded recesses (not shown) in grip 50. It is understood that receiver 18 may similarly be coupled to either the top end or bottom end on either the right or left side of spade grip device 42, by mounting screws 70 threaded into the corresponding threaded recesses at either the top or bottom on the right or left side grip 50.

In some embodiments, the arm 12 of a weapon training and firing aid 10 may be articulatable. For example, in some embodiments, an arm 12 may comprise at least one joint therein, wherein the at least one joint allows segments of the arm 12 to rotate relative to each other in order to conform the arm 12 to a desirable configuration. However, this is not intended to be limiting. The at least one joint may be any of a variety of hinged joints, whether ball-and-detent or not, splined or not, having stops or not, spring-loaded or not, and the like, or any combination thereof, known now or in the future, and securable by any of a variety of securing means, known now or in the future, whereby at least one segment of the arm 12 may be rotatable about the at least one joint while a securing means of the at least one joint is in a disengaged position and not rotatable about the at least one joint while the securing means of the at least one joint is in a disengaged position.

In some embodiments, the arm 12 may comprise a single component of unitary construction. In other embodiments, the arm 12 may comprise a plurality of segments removably coupled together. For example, as shown in FIG. 3, the distal segment 66 of the arm 12 may be removable from that segment 68 of the arm 12 proximate the first end 16. In some embodiments, various segments of the arm 12 may be telescoping, or otherwise extendable and retractable, such as by a securable slide mechanism, for example.

In operation, an Aid 10 may be coupled to a direct fire weapon system 14, as described, wherein a distal end 38 of the arm 12 of the Aid 10 may be disposed over a user's shoulder or under the user's arm, as may be desired, for example, wherein the user may be a gunner positioned behind the weapon system 14, relative to the direction of fire, leaving the user's hands free to engage and manipulate any of a light, laser, sighting system, and the like, coupled to the weapon system 14, or to direct any light, laser, illumination device, aiming device, fire control device, coaxial-mounted weapon, and the like, or any combination thereof, coupled to the weapon system 14. The user may utilize his or her body to stabilize and control direction and aiming of the weapon by engaging the distal end 38 of the arm 12, for example, with the user's shoulder and neck or the user's side and underarm, accordingly, or by any other suitable body part. The length of the arm 12, extending from the weapon system 14, provides additional leverage, control, and a sense of direction to the user, while elevating and/or traversing the weapon, not otherwise available to the user without the Aid 10. The additional leverage provided by the arm 12 further allows a user to more quickly traverse and/or elevate any other system coupled to the weapon system 14 than without the Aid 10. Aid 10 may be used by a user in any of a variety of firing positions, such as while standing, kneeling, or sitting, for example, and while the weapon system 14 is coupled to a weapon mount, for example, the weapon mount being attached to any of a variety of base platforms, such as to a vehicular gun ring, swing arm mounting, pedestal, tripod, and the like.

Some embodiments may comprise a pad 40 coupled to the distal end 38 of the arm 12, for providing comfort to a user in contact with the arm 12. For example, as shown in FIGS. 1-3, a tubular pad 40 may be removably coupled around the distal end 38. The pad 40 may be coupled to and removed from the arm 12 by simply sliding the pad 40 on or off of the arm 12, respectively. In addition, any of a variety of other optional components (not shown) may be coupled to or integrated with an Aid 10, of the present invention, including, without limitation, any of a variety of handgrips, electronic controls, firing aids, sighting aids, and the like, and/or any combination thereof.

Figure 8:
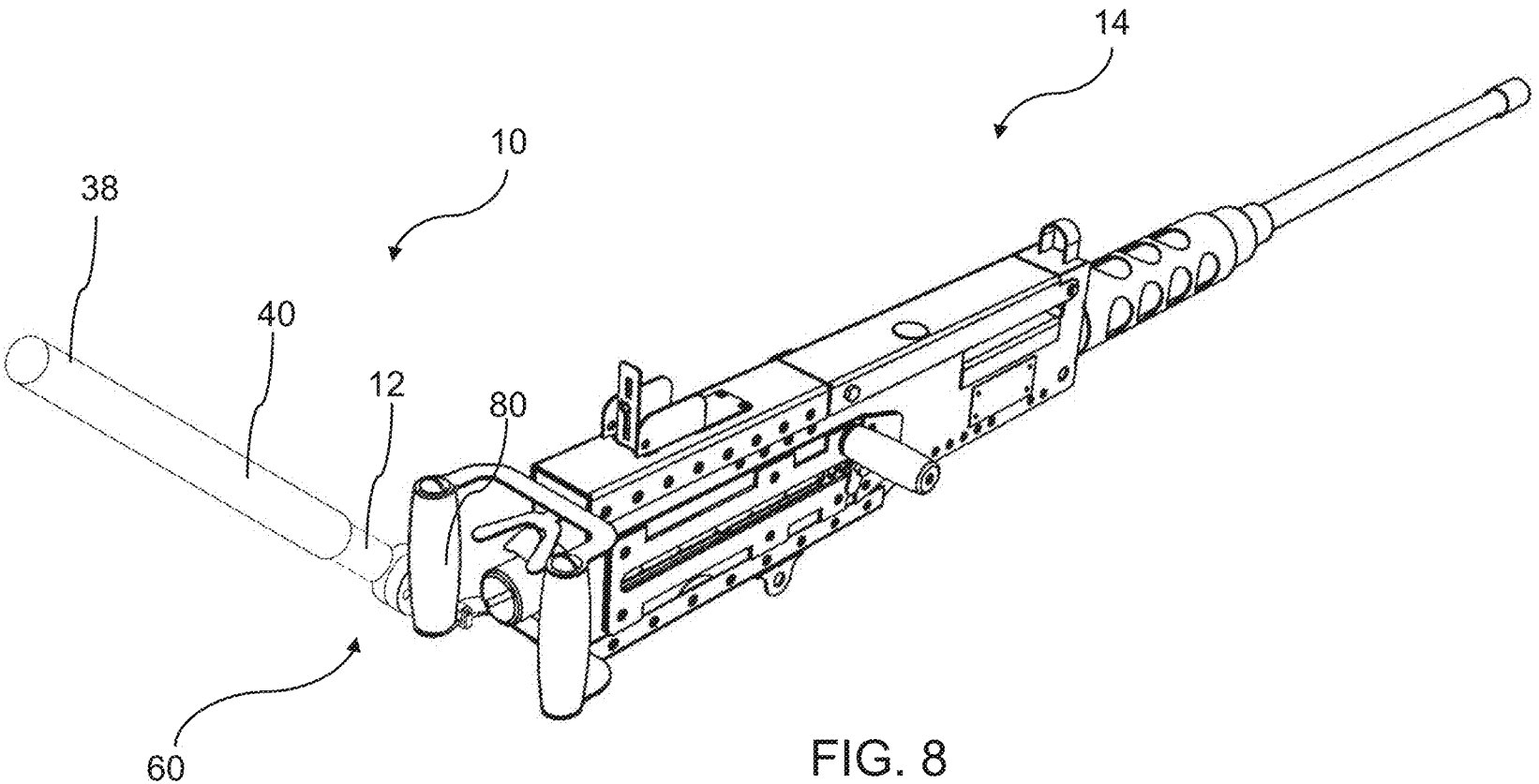
FIG. 8 is a perspective view of an embodiment of a weapon system training and firing aid coupled to a weapon system.
Figure 9:
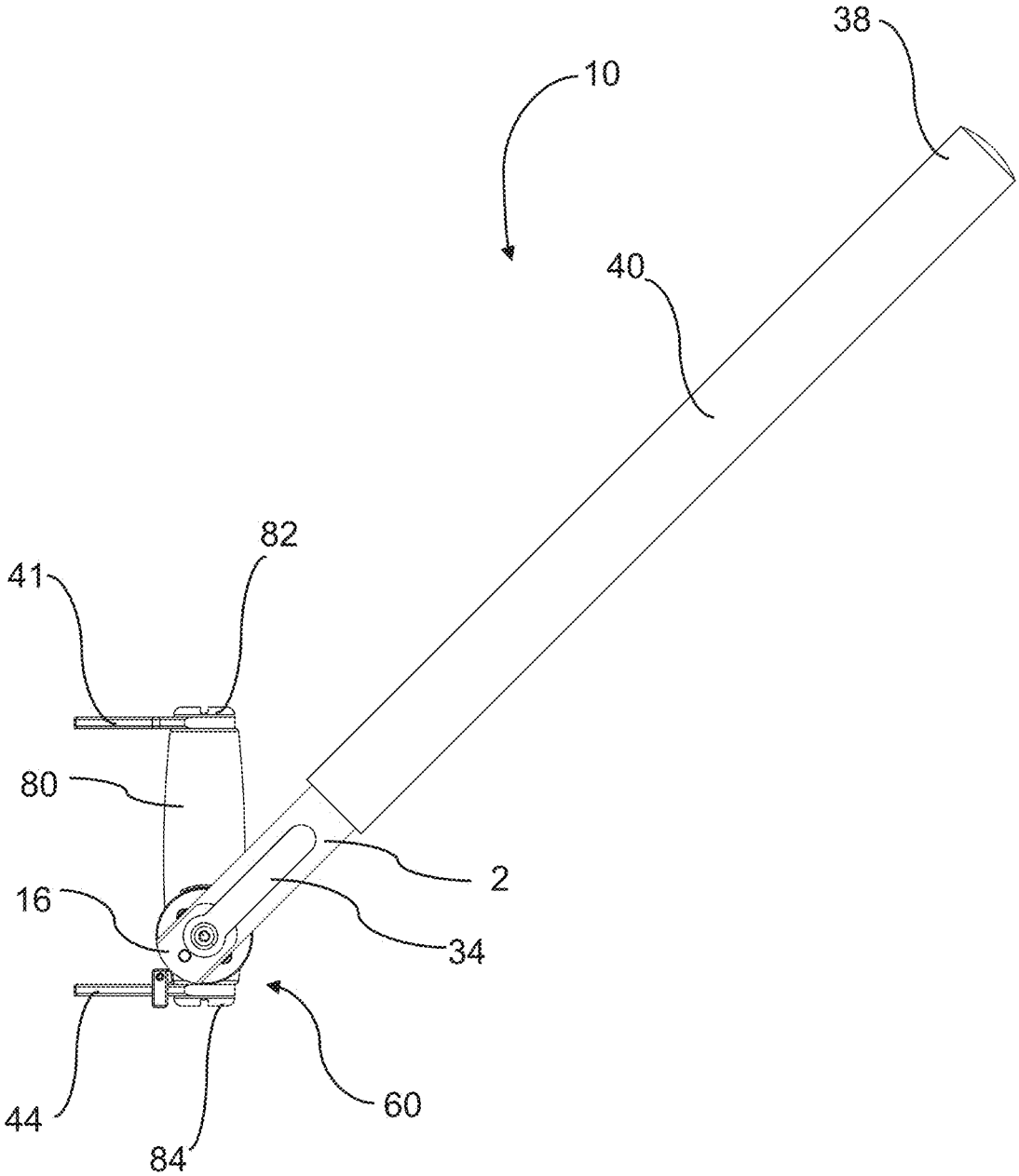
FIG. 9 is a side view of a weapon system training and firing aid, according to an embodiment.
Figure 10:
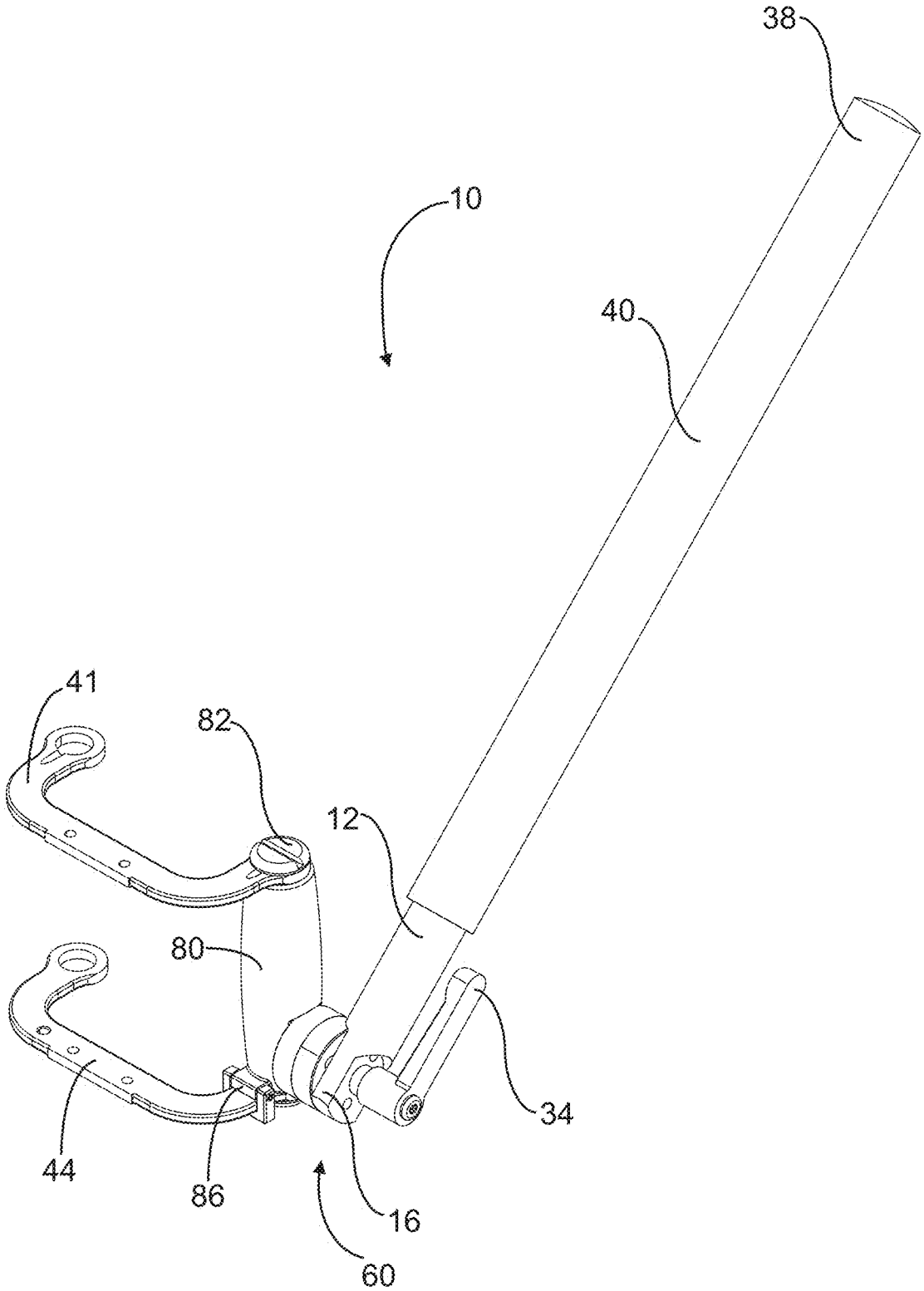
FIG. 10 is a perspective view of a weapon system training and firing aid, according to an embodiment.
Figure 11:
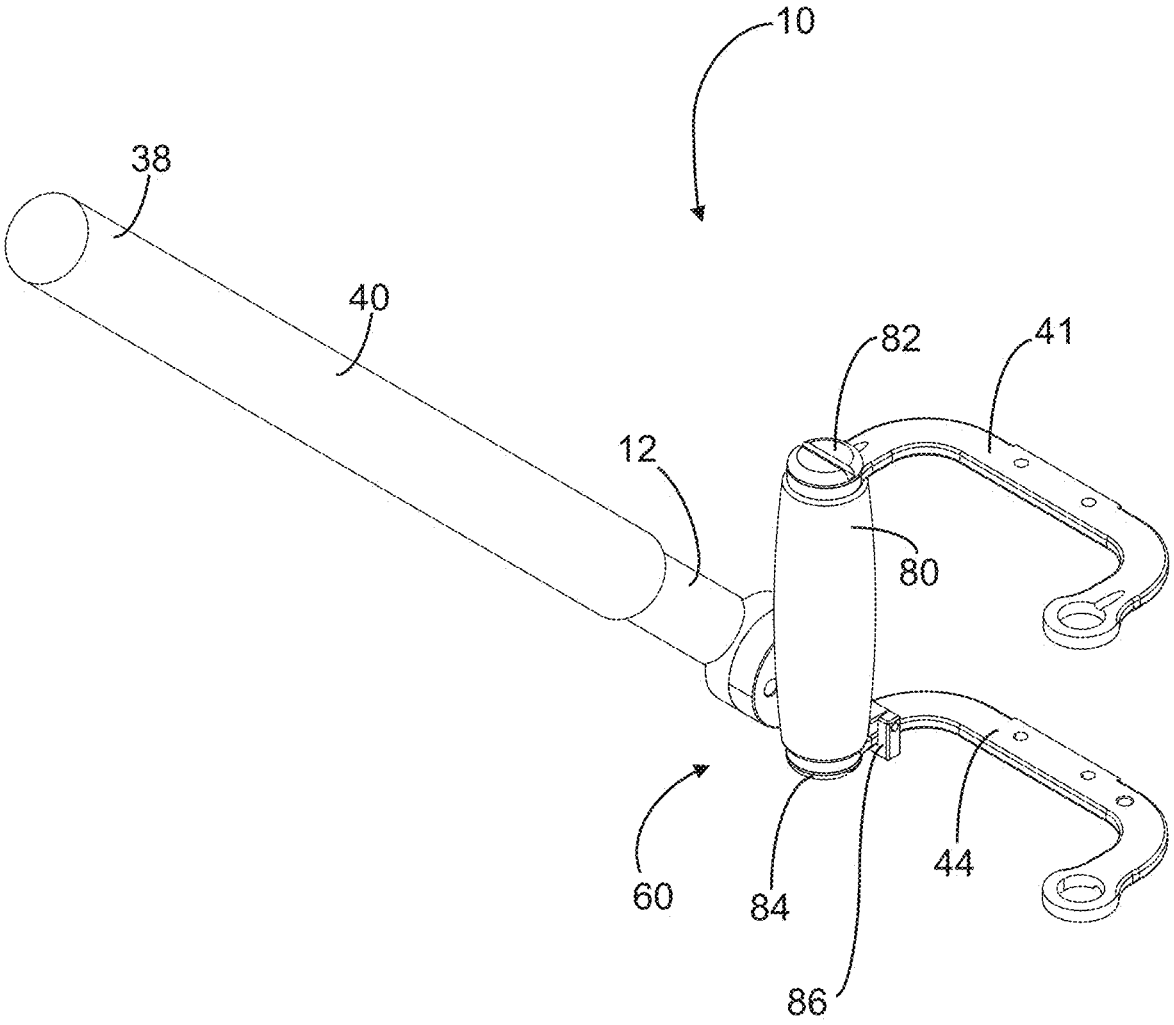
FIG. 11 is a perspective view of a weapon system training and firing aid, according to an embodiment.
Figure 12:
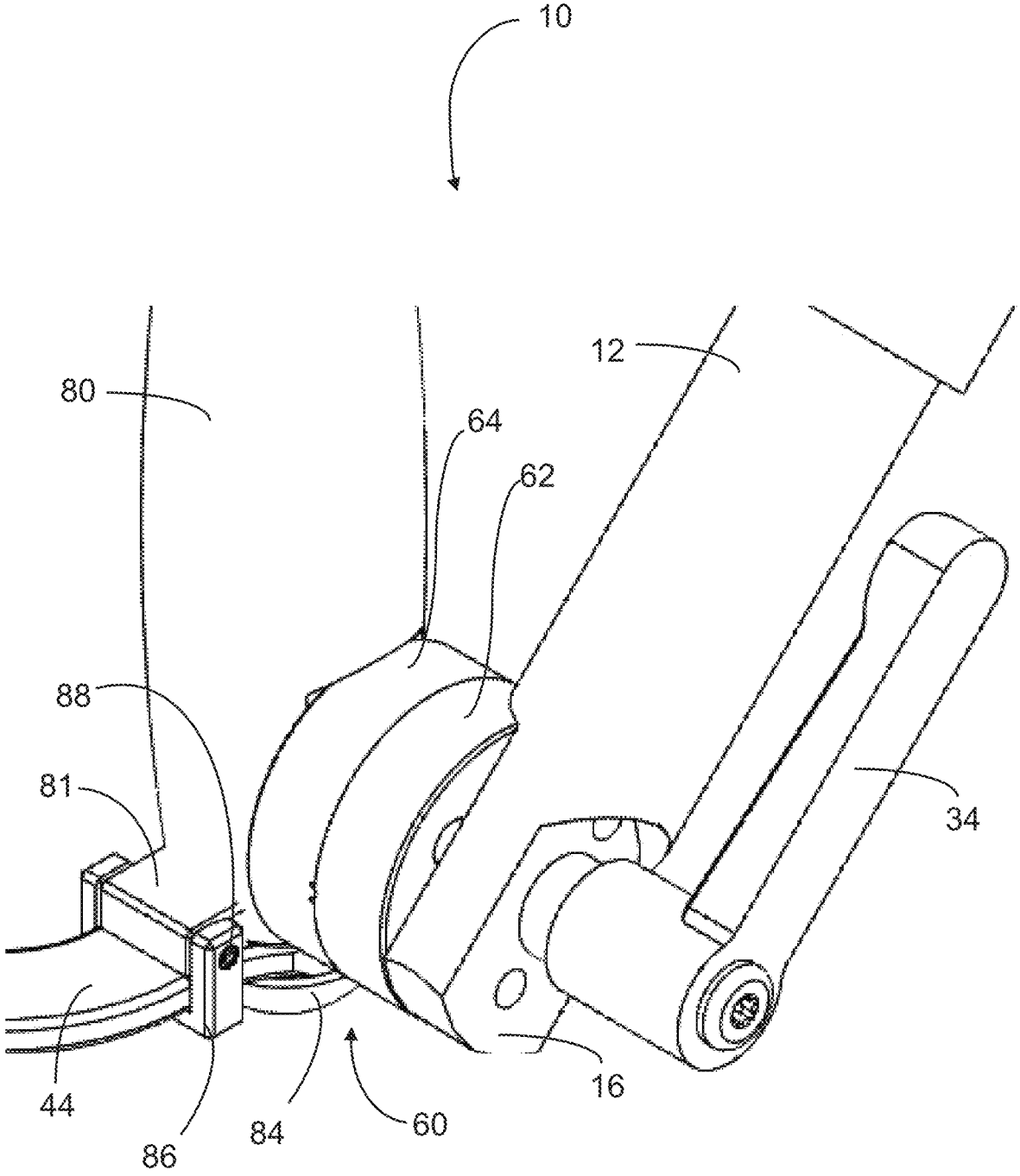
FIG. 12 is a perspective view of a weapon system training and firing aid, according to an embodiment.
Figure 13:
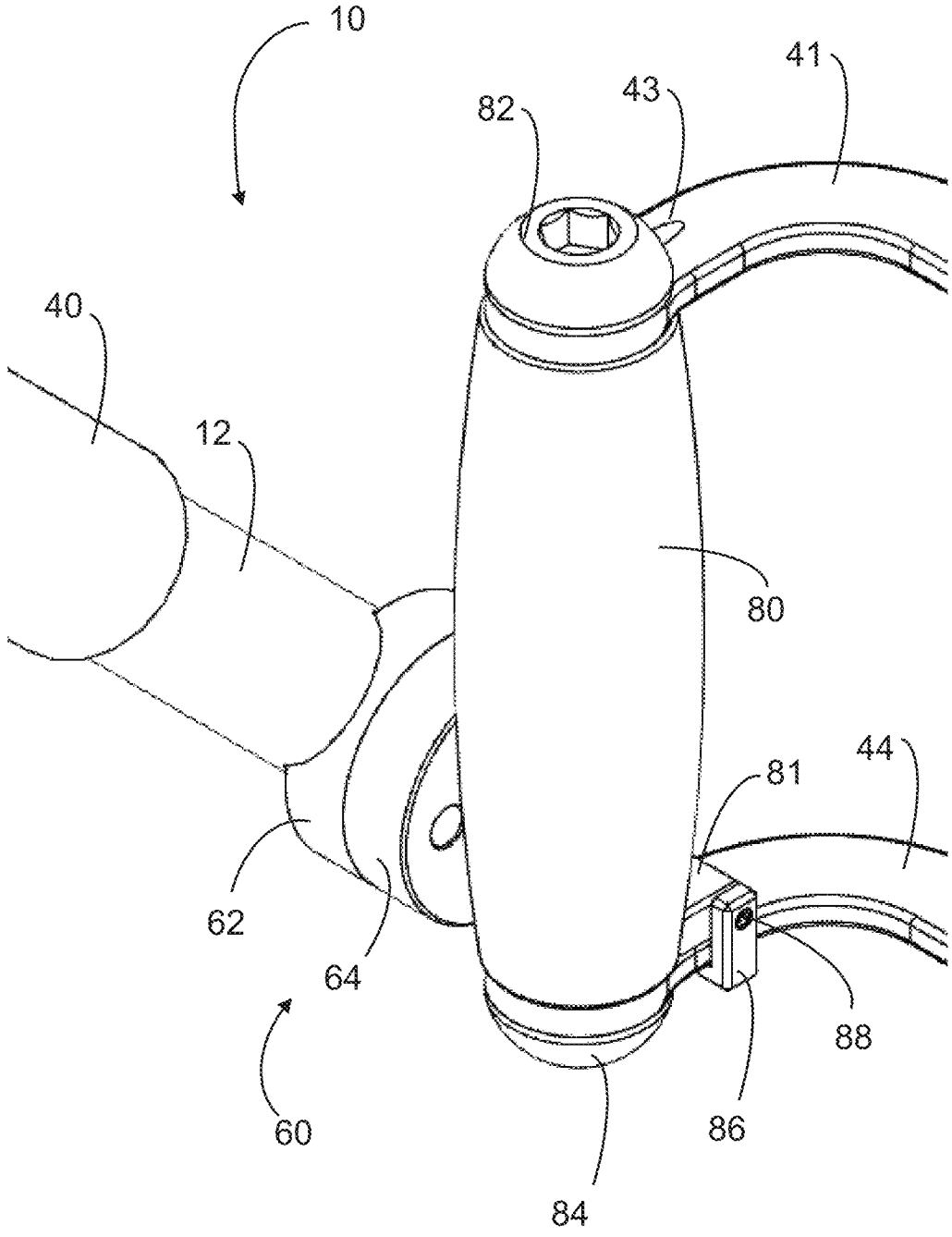
FIG. 13 is a perspective view of a weapon system training and firing aid, according to an embodiment.

Another embodiment of a firing aid 10, is depicted in FIGS. 8-15B. The Aid 10 may comprise an elongate arm 12 configured to be coupled to a weapon system 14, wherein a first end 16 of the Aid 10 is coupled to the weapon system 14 and the arm 12 extends in a generally rearward direction from the weapon system 14, as shown in FIG. 8.

Referring to FIGS. 8-13, an Aid 10, of the present invention may comprise a replacement grip 80, coupled to the first end 16, for coupling the arm 12 to a weapon system 14. For example, the weapon system 14, shown in FIG. 8, comprises spade grip device having an upper cross member 41, having a lower cross member 44 with one grip 50 coupled on a right side of the spade grip device between the upper cross member 41 and the lower cross member 44 and the replacement grip 80 coupled on a left side of the spade grip device between the upper cross member 41 and the lower cross member 44. The first end 16 of the Aid 10 may be coupled to the replacement grip with a quick-release mechanism 34 may be configured to secure and release a splined coupler 60 that is coupled to the replacement grip 80. The spline coupler 60 may include a first portion 62 and a second portion 64, wherein the first portion 62 of splined coupler 60 is coupled to first end 16 of arm 12 and the second portion 64 of splined coupler 60 is coupled to replacement grip 80. When quick-release mechanism 34 is secured, splines of the first portion 62 engage corresponding splines of the second portion 64 to prevent rotation of the first portion 62 with respect to the second portion 64. When quick-release mechanism 34 is disengaged, first portion 62 is free to rotate with respect to second portion 64. In some embodiments, the quick-release mechanism 34 may be spring-loaded or the splined coupler 60 may be spring loaded, such as a spring between the first portion 62 and the second portion 64 to bias them apart, wherein the quick release mechanism operates to move the first portion 62 and the second portion 64 between an engaged position and a disengaged position by applying force or releasing force. Quick-release mechanism 34 may be large enough to be quickly and easily manipulated by a user wearing gloves.

Figure 14A:
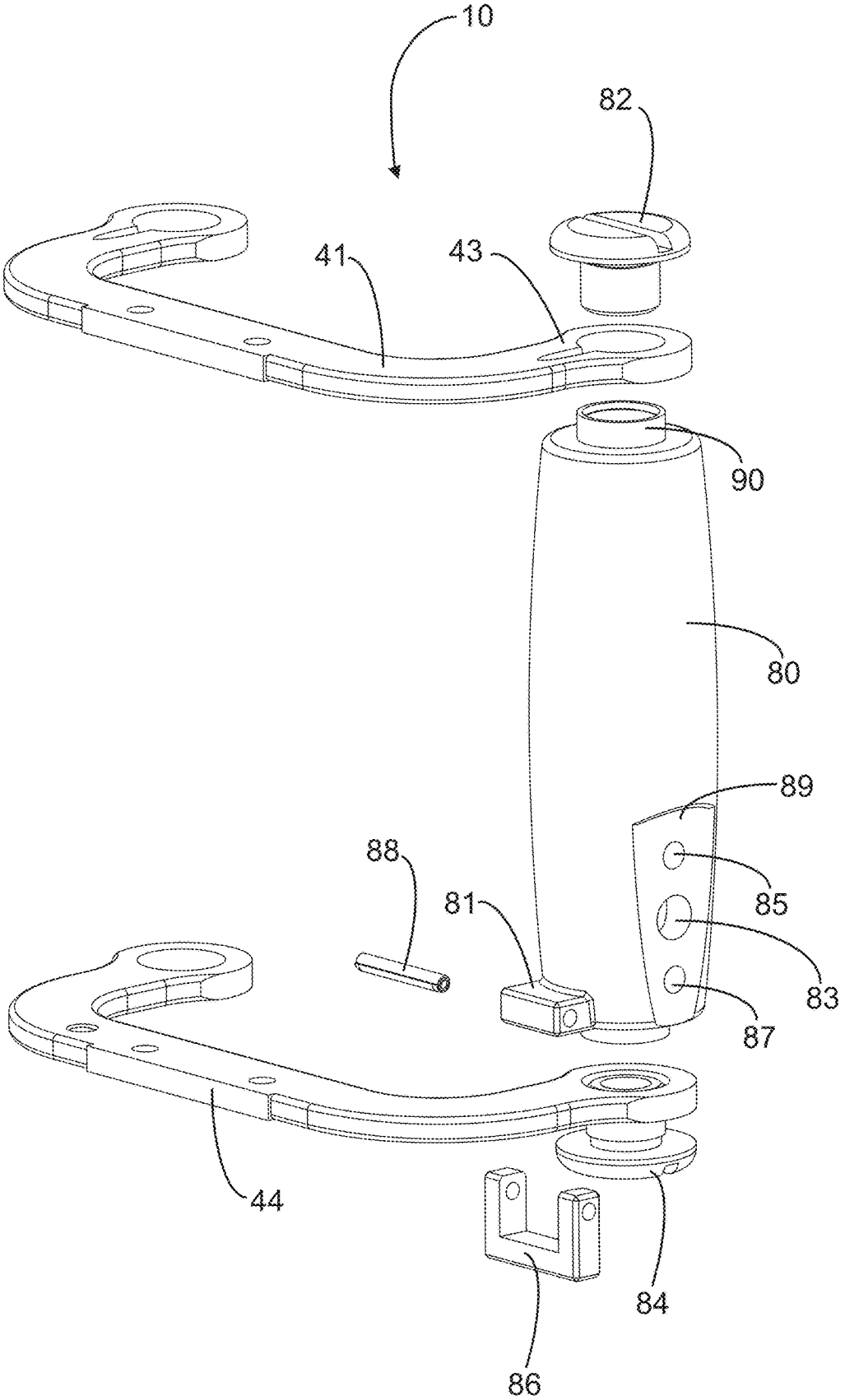
FIG. 14A is an exploded perspective view of a portion of a weapon system training and firing aid, according to an embodiment.
Figure 14B:
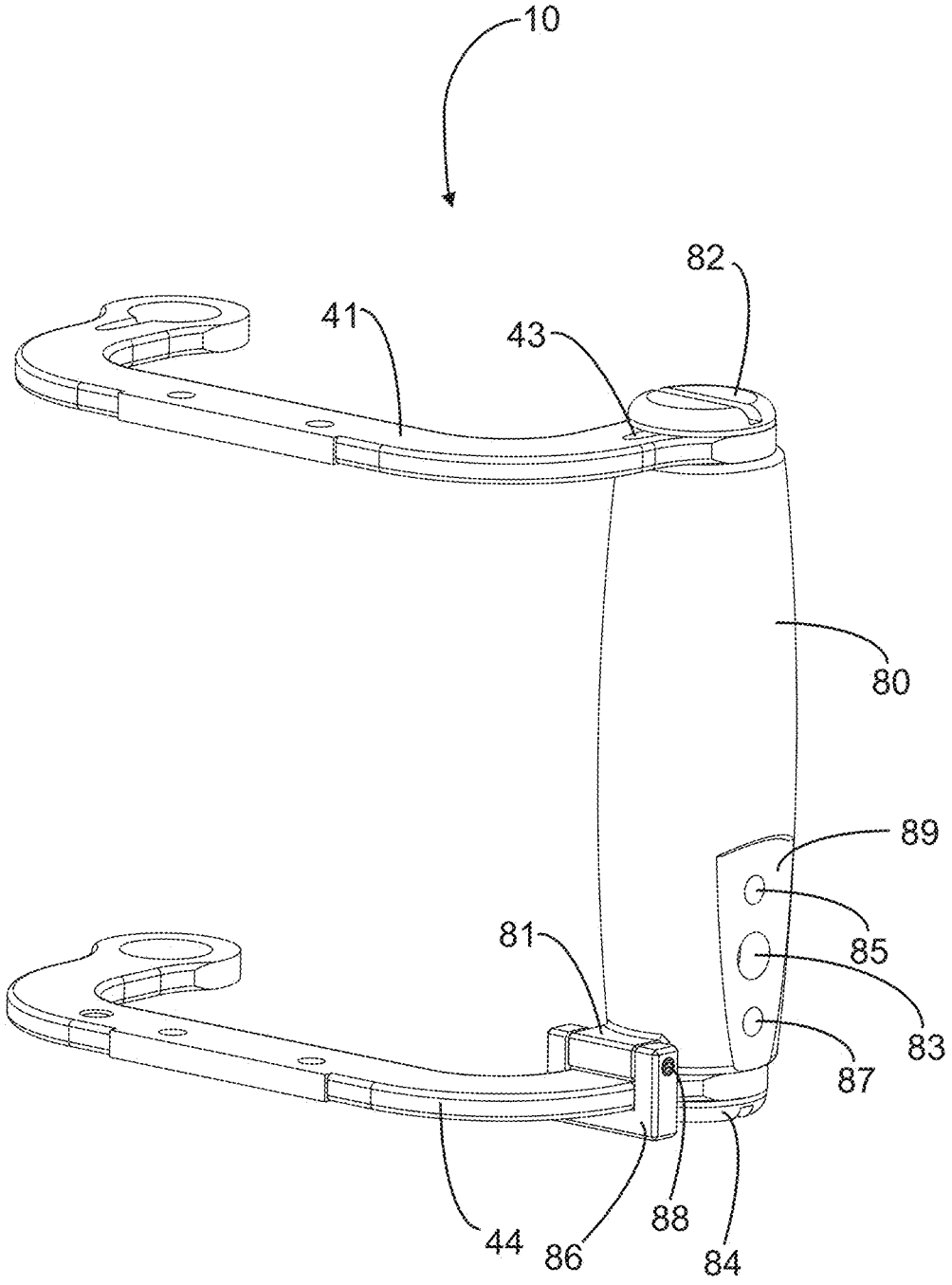
FIG. 14B is a perspective view of a portion of a weapon system training and firing aid, according to an embodiment.
Figure 15A:
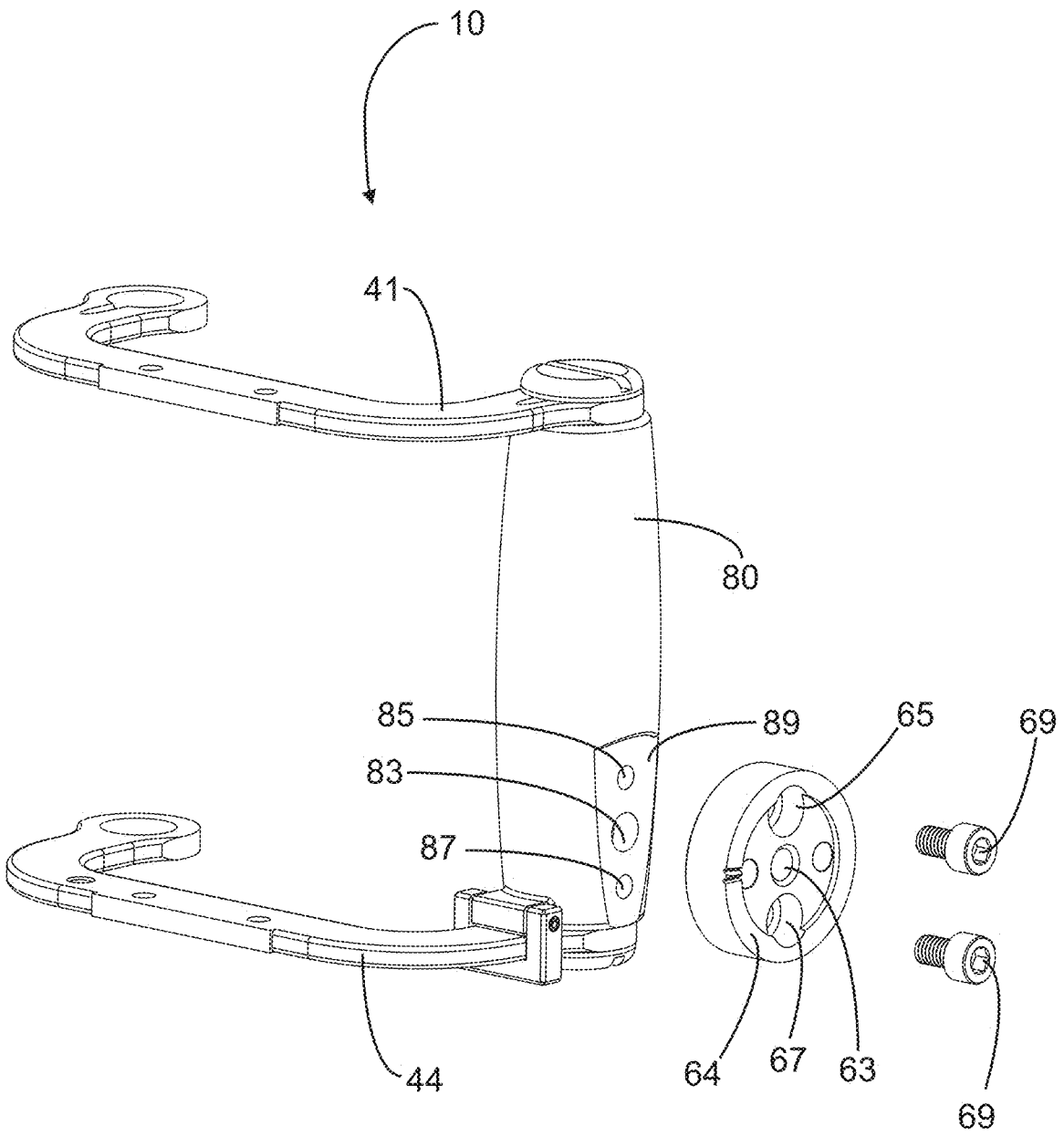
FIG. 15A is an exploded perspective view of a portion of a weapon system training and firing aid, according to an embodiment.
Figure 15B:
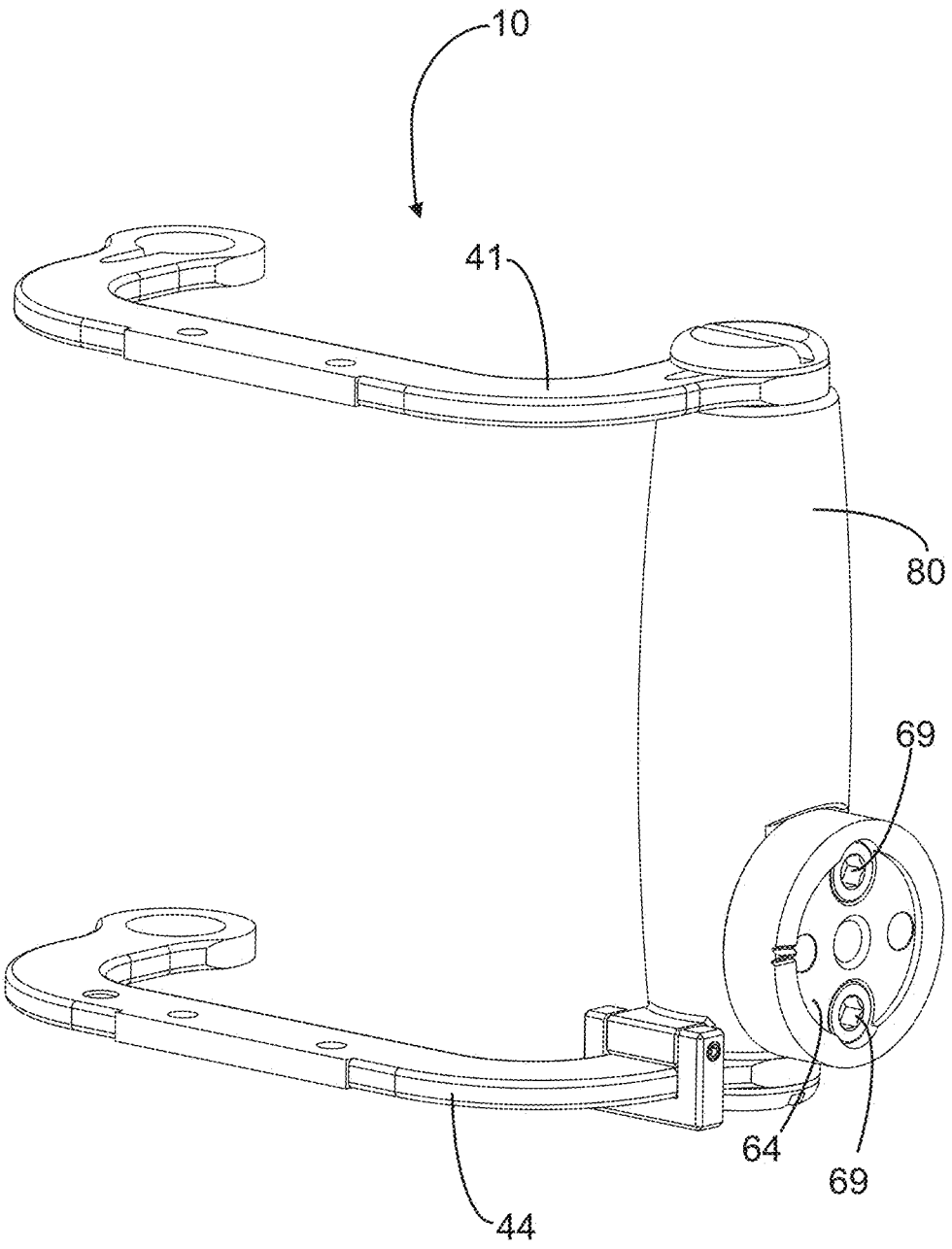
FIG. 15B is a perspective view of a portion of a weapon system training and firing aid, according to an embodiment.

Referring further to FIGS. 14A and 14B, replacement grip 80 may be configured to be coupled to spade grip device between the upper cross member 41 and lower cross member 44 utilizing couplers 82 and 84. Couplers 82 and 84 may engage a tube 90 extending through the replacement grip 80 to couple the replacement grip 80 between the upper cross member 41 and the lower cross member 44. In these embodiments, the couplers 82 and 84 may be bolts that engage threads in the tube 90 that extends though the replacement grip 80. In some embodiments, the replacement grip 80 is compressed between the upper cross member 41 and the lower cross member 44.

As the couplers 82 and 84 are tightened, the replacement grip 80 has a tendency to rotate. In order to prevent rotation and ensure the proper orientation of the Aid 10 with respect to the weapon system 14, the handle includes a protrusion 81 at a bottom end of the replacement grip 80. A C-shaped clamp 86 may be coupled around a portion of the lower cross member 44 and engage the protrusion 81 with a pin 88. The clamp 86 coupled to the protrusion 81 operates to maintain the proper orientation of the replacement grip 80 and the Aid 10 when tightening the couplers 82 and 84 (see FIGS. 14A and 14B). Additionally, in order to resist the loosening of the couplers 82 and 84, embodiment may include a small recess 43 (see FIGS. 12, 14A and 14B), wherein an abrupt force (such as a stake with a hammer) may be applied to the couplers 82 and 84 to engage the couplers 82 and 84 with small recesses 43 to modify the couplers 82 and 84 with a notch that is in contact with and engages the small recesses 43. This operates to resist rotation of the couplers 82 and 84. This is important because operation of the weapon system 14 provides significant vibrations that can cause bolts to rotate and this engagement resists such rotation during firing of the weapon system 14.

The replacement grip 80, as shown in FIGS. 14A-15B, may include a flat recessed surface 89 formed in a side of the replacement grip 80 and located near a bottom end of the grip 80, such that when coupled to the spade grip device, the flat recessed surface 89 is adjacent the lower cross member 44. The flat recessed surface 89 may include quick release aperture 83, upper mounting aperture 85 and lower mounting aperture 87. The upper mounting aperture 85 and the lower mounting aperture 87 may be threaded. These apertures 83, 85, 87 operate to couple the quick-release mechanism 34 to the grip 80 and to secure the splined coupler 60 to the replacement grip 80. Second portion 64 of the splined coupler 60 may include a quick release aperture 63, an upper mounting aperture 65 and a lower mounting aperture 67. The second portion 64 of the splined coupler 60 may then be placed in contact with and engage the flat recessed surface 89 of the replacement grip 80. Mounting bolts 89 may be coupled through the upper mounting aperture 65 and the lower mounting aperture 67 of the second portion 64 of the splined coupler 60, and threaded into the upper mounting aperture 85 and the lower mounting aperture 87 of the replacement grip 80. This operates to couple the second portion 64 of the splined coupler 60 to the replacement grip 80. The coupling also aligns the quick release aperture 83 of the grip 80 with the quick release aperture 63 of the second portion 64 of the splined coupler 60. This allows the quick release mechanism 34 to couple the first portion 62 of the splined coupler 60 to the second portion 64 of the splined coupler 60. This also operates to couple the elongate arm 12 to the first portion 62 of the splined coupler 60 with the quick release mechanism 34.

Some embodiments of Aid 10 may comprise a quick-release mechanism 34 coupled between arm 12 and replacement grip 80. The quick-release mechanism 34 provides a means of adjusting the angle of arm 12 with respect to the direction of fire of weapon system 14, when coupled thereto. In operation of the embodiment shown in FIGS. 7-12, the angle of arm 12 with respect to the direction of fire of weapon system 14 may be adjusted by first releasing quick-release mechanism 34, adjusting the angle of arm 12, and the securing quick-release mechanism 34 again. For example, in some cases, a user may wish to extend distal end 38 of arm 12 over the user's shoulder, in which case arm 12 may be adjusted to extend upward over the user's shoulder. In other cases, a user may wish to extend distal end 38 of arm 12 under the user's arm and to the user's side, in which case arm 12 may be adjusted to extend in a lower direction under the user's arm and to the user's side. The direction of rotation of arm 12, about the quick-release mechanism 34, is similar as the positions indicated in FIG. 3 by the arrows, and alternative exemplary non-limiting relative positions of arm 12 are shown in dashed lines. Such angle adjustments may accommodate users of different sizes and heights, and having different angle preferences, for example. This quick-release mechanism 34 may operate in conjunction with the spline coupler 60 as discussed above.

Although Aid 10, as shown in the drawings, and described above, is configured to be coupled to a weapon system in the manner shown in the drawings and described above, this is not intended to be limiting. For example, Aid 10 may be configured to be coupled to either the right or left side of a weapon system 14. Furthermore, Aid 10 may be configured to be coupled to any of a variety of other weapon systems known now or in the future, and by any of a variety of coupling means, known now or in the future. Such a weapon system 14 may be internally powered or may be externally-powered, whether the external power is provided manually, mechanically, electrically, pneumatically, hydraulically, or any combination thereof. For example, embodiments of an Aid 10 may be coupled to a weapon system 14 by one or more screws, clips, pins, quick-release pins, clamping devices, and the like, wherein the Aid 10 is configured to be coupled to the weapon system 14 without modification of the weapon system 14 except for replacing a grip 50 with the replacement grip 80 of the Aid 10.

The drawing figures depict embodiments of the present invention being utilized with certain weapons and weapon systems. It will be understood that the invention includes but is not limited to the depicted weapon systems. The weapon system training and firing aid 10 may be utilized with minigun variants, such as the 134D, GAU-17, M134, and Mk 44. The weapon system training and firing aid may also be used with M2 Browning heavy machine gun variants, such as the M2A1, M2 HB, M2 HQCB HMGs. The weapon system training and firing aid may also be used with automatic grenade launchers, such as the Mk19 AGL, and spade grip equipped general purpose machine guns like the M240D GPMG, M240H GPMGs, and other weapon systems that employ a spade grip.

The components defining any weapon system training and firing aid 10, of the present invention, may be formed of any of many different types of materials or combinations thereof that can readily be formed into shaped objects provided that the components selected are consistent with the intended operation of a weapon system training and firing aid 10. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as copper, zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any weapon system training and firing aid 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, sewing, any combination thereof, and/or the like for example, depending on, among other considerations, the particular material forming the components. Other forms of manufacture might include additive manufacturing, such as, but not limited to, selective laser sintering. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A direct fire weapon system training and firing aid, comprising:

an elongate arm, wherein the arm comprises a first end configured to be coupled to a direct fire weapon system, and an opposed distal end configured to extend in a rearward direction from the weapon system;

a receiver extending at an angle from the first end, the receiver configured to couple to a spade grip of the weapon system; and a joint coupled between the arm and the receiver, wherein the arm is rotatable about the joint with respect to the receiver.

2. The direct fire weapon system training and firing aid of claim 1, wherein the weapon system is an externally-powered direct fire weapon system or an internally powered direct fire weapon system.

3. The direct fire weapon system training and firing aid of claim 1, wherein the weapon system is coupled to a weapon mount.

4. The direct fire weapon system training and firing aid of claim 1, wherein the joint is a splined joint releasably securable by a quick-release mechanism coupled thereto, wherein the quick-release mechanism is changeable between an engaged position and a disengaged position.

5. The direct fire weapon system training and firing aid of claim 1, further comprising a pad coupled to the distal end of the arm.

6. The direct fire weapon system training and firing aid of claim 1, wherein the arm is telescopic.

7. A method of using a direct fire weapon system training and firing aid, the method comprising:

providing a firing aid, the firing aid comprising an elongate arm having a first end and a second end, a receiver extending at an angle from the first end, and a joint coupled between the elongate arm and the receiver, wherein the arm is rotatable about the joint with respect to the receiver;

coupling the receiver to a spade grip of a weapon system; and rotating the elongate arm about the joint to extend the elongate arm in a rearward direction from the weapon system.

8. The method of claim 7, wherein the weapon system is an externally-powered direct fire weapon system or an internally powered direct fire weapon system.

9. The method of claim 7, further comprising coupling the weapon system to a weapon mount.

10. The method of claim 7, wherein the joint is a splined joint releasably securable by a quick-release mechanism coupled thereto, wherein the quick-release mechanism is changeable between an engaged position and a disengaged position.

11. The method of claim 7, wherein the elongate arm is telescopic.

12. The method of claim 7, further comprising placing the second end of the elongate arm, the second end of the elongate arm comprising a pad coupled thereto, over a shoulder or under an arm of a user firing the weapon system.

13. A direct fire weapon system training and firing aid, comprising:

an elongate arm, wherein the arm comprises a first end configured to be coupled to a direct fire weapon system, and an opposed distal end configured to extend in a rearward direction from the weapon system;

a receiver extending at an angle from the first end, the receiver configured to couple to a housing of the weapon system; and a joint coupled between the arm and the receiver, wherein the arm is rotatable about the joint with respect to the receiver.

14. The direct fire weapon system training and firing aid of claim 13, wherein the weapon system is an externally-powered direct fire weapon system or an internally powered direct fire weapon system.

15. The direct fire weapon system training and firing aid of claim 13, wherein the weapon system is coupled to a weapon mount.

16. The direct fire weapon system training and firing aid of claim 13, wherein the joint is a splined joint releasably securable by a quick-release mechanism coupled thereto, wherein the quick-release mechanism is changeable between an engaged position and a disengaged position.

17. The direct fire weapon system training and firing aid of claim 13, further comprising a pad coupled to the distal end of the arm.

18. The direct fire weapon system training and firing aid of claim 13, wherein the arm is telescopic.

* * * * *